US006250978B1

(12) United States Patent
Corliss

(10) Patent No.: US 6,250,978 B1
(45) Date of Patent: Jun. 26, 2001

(54) STEAM PHASE CHANGE WATERJET DRIVE

(76) Inventor: Joseph J. Corliss, 10119 Vanderbilt Cir., Rockville, MD (US) 20850

( * ) Notice: Subject to any disclaimer, the term of this patent is extended or adjusted under 35 U.S.C. 154(b) by 0 days.

(21) Appl. No.: 09/505,832

(22) Filed: Feb. 17, 2000

(51) Int. Cl.[7] ..... B63H 11/00
(52) U.S. Cl. ..... 440/38; 440/44; 60/227
(58) Field of Search ..... 440/38, 44, 45; 60/221, 222, 227

(56) References Cited

U.S. PATENT DOCUMENTS 5,989,082 * 11/1999 Corliss ..... 440/45

* cited by examiner

*Primary Examiner*—Jesus D. Sotelo
(74) *Attorney, Agent, or Firm*—Norman B. Rainer

(57) ABSTRACT

A waterjet drive engine for the propulsion of large ships includes an elongated water conduit having a rearwardly directed exhaust portal, a forward extremity having a water intake portal, and a middle portion of larger diameter than the diameter of the exhaust portal. A hollow axially symmetrical chamber is centrally positioned within the middle portion, defining therewith an annular interstitial zone through which ambient water is caused to flow. A shaft driven by the ship's power system extends into the chamber and is provided with a circular array of propulsion blades positioned within the interstitial zone and adapted to force water rearwardly. A plurality of nozzles enter the chamber and direct high pressure steam toward the exhaust portal. The effect of the steam is to add an augmenting force to the rotative motion of the shaft.

7 Claims, 1 Drawing Sheet

STEAM PHASE CHANGE WATERJET DRIVE

BACKGROUND OF THE INVENTION

1. Field of the Invention

This invention relates to propulsion means for large ships, and more particularly concerns a steam-driven rotary member that acts directly on the water upon which the ship is floating.

2. Description of the Prior Art

It is well known to employ turbine-driven propellers for the propulsion of large ships. Such turbines may be driven by steam or other heated or high velocity gas caused to impinge tangentially upon the blades of a multi-bladed rotor. The rotor shaft is usually co-extensive with a conventional propeller shaft.

Another type of propulsion system that has been disclosed for use in large ships is a waterjet drive wherein water is forced rearwardly at high velocity to produce a propulsive thrust effect analogous to that of rocket engines. The waterjet propels the ship by virtue of a reaction force imparted by the momentum of rearwardly ejected water. The velocity and total mass of the rearwardly expelled water accordingly determine the total propulsive force. It has earlier been disclosed to employ a steam-driven turbine to operate the waterjet drive. The utilized steam may originate from conventional or nuclear powered boilers.

It is a primary object of the present invention to provide a turbine-driven waterjet drive engine having improved performance characteristics.

It is a further object of this invention to provide an improved turbine-driven waterjet drive engine as in the foregoing object of durable, simple construction amenable to low cost manufacture.

These objects and other objects and advantages of the invention will be apparent from the following description.

SUMMARY OF THE INVENTION

The above and other beneficial objects and advantages are accomplished in accordance with the present invention by a turbine-driven waterjet drive engine comprising :

a) a water conduit elongated upon a center axis and having a rearwardly directed exhaust portal centered upon said axis, a middle portion of larger diameter than the diameter of said exhaust portal and symmetrically configured with respect to said axis, and a forward extremity having a water intake portal, b) a hollow axially symmetrical chamber centrally positioned within said middle portion and defining therewith an annular interstitial zone, said chamber having a streamlined forward portion and convergently tapered rear portion having an axially centered exit port, c) an axially centered shaft which enters said water conduit at said forward extremity, extends through said forward chamber portion, and terminates in a distal extremity, said shaft being journaled with respect to said water conduit and forward chamber portion for rotation about said axis, d) a number of propulsion blades associated with the distal extremity of said shaft and radially directed therefrom in a centrifugally balanced circular array positioned within said interstitial zone and pitched so as to drive water rearwardly with rotation of said shaft, and e) a plurality of steam injector nozzles disposed within said forward chamber portion and directed toward said exit port.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
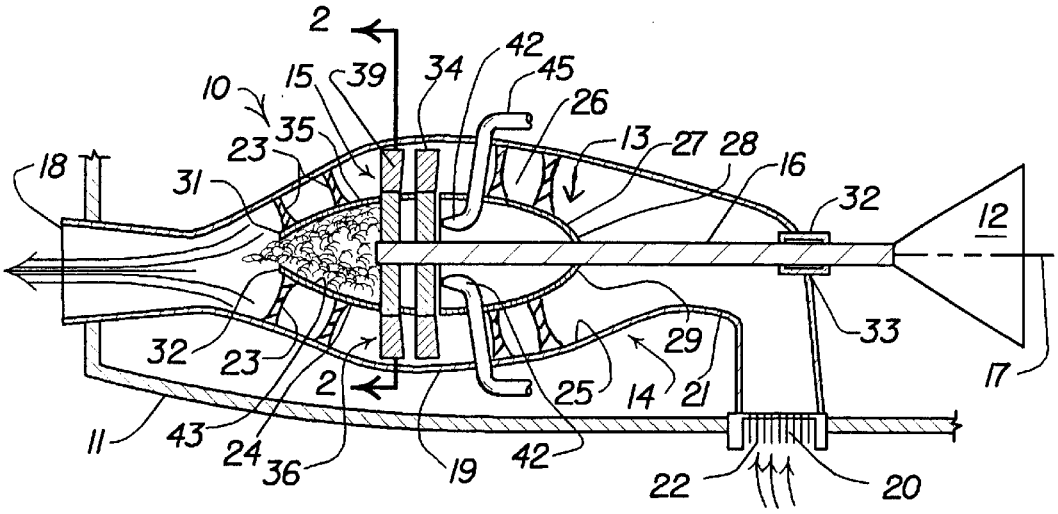
FIG. 1 is a schematic side view of an embodiment of the waterjet drive of the present invention.
Figure 2:
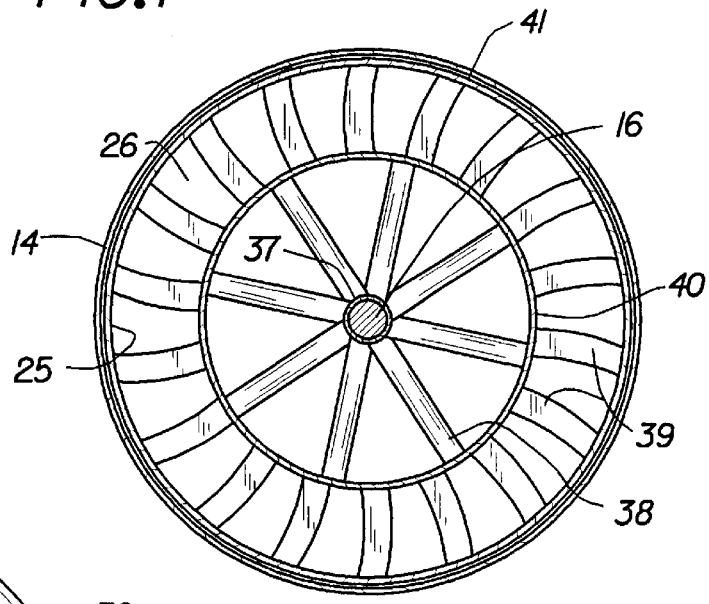
FIG. 2 is a sectional view taken upon the line 2—2 of FIG. 1.
Figure 3:
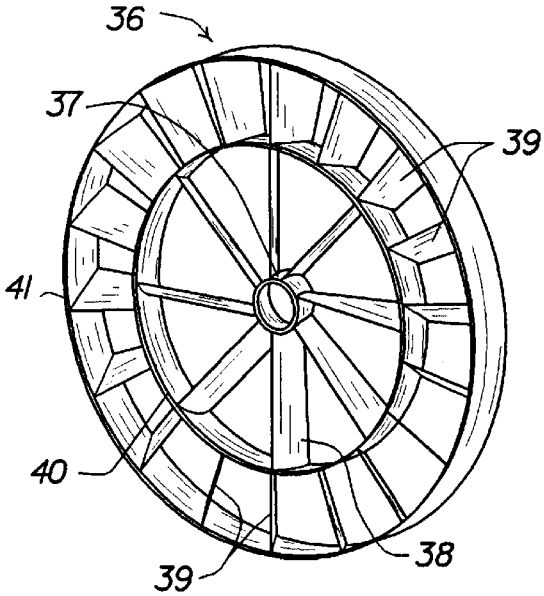
FIG. 3 is a perspective view of the power blade component of the waterjet drive of FIG. 1.

Referring now to FIGS. 1–3 an embodiment of the waterjet drive 10 of the present invention is shown emplaced within a boat hull 11 and powered by a turbine unit 12.

Waterjet drive 10 is comprised of chamber 13 disposed within water conduit 14, and power blade assembly 15 connected by shaft 16 to said turbine unit.

Water conduit 14 is elongated upon a center axis 17 and has a rearwardly directed and outwardly flared exhaust portal 18 of circular perimeter centered upon said axis. A middle portion 19 of said conduit has a larger diameter than the diameter of said exhaust portal, and is symmetrically configured with respect to said axis. A water intake portal 20 is located adjacent the forward extremity 21 of said water conduit. A screen 22 may be positioned upon said intake portal to prevent intake of debris from the ambient water surrounding the hull of the boat.

Chamber 13 is supported by a series of struts 23 which extend in joinder between the exterior surface 24 of chamber 13 and the interior surface 25 of said water conduit. Said chamber is positioned by said struts in a manner to produce an annular interstitial zone 26 which surrounds said steam chamber. The forward portion 27 of chamber 13 has a streamlined contour, and is provided with an aperture 28 equipped with a first sealing bushing 29 adapted to receive shaft 16 that is rotated by turbine unit 12. The primary function of forward portion 27 is to streamline the flow of water through interstitial zone 26. The rear portion 31 of chamber 13 is substantially conically shaped, convergently tapering rearwardly to an exit port 32 centered upon axis 17. Forward portion 27 and rear portion 31 are essentially separate halves of chamber 13, which are brought together in spaced apart, facing juxtaposition defining an intervening region 34.

Shaft 16 enters water conduit 14 en route to forward chamber portion 27 through second sealing bushing 32 secured within aperture 33 at the forward extremity 21 of said water conduit. Shaft 16 is longitudinally centered upon axis 17, and terminates in a distal extremity 35 located in intervening region 34.

At least one propulsion assembly 36 is secured to the distal extremity 35 of shaft 16. Said propulsion blade assembly is comprised of a hub 37, a plurality of radial support members 38 outwardly directed from said hub, and power blades 39 associated with the outermost extremities of said radial support members. Blades 39 may either be attached directly to said radial support members, or may be secured within inner and outer bands 40 and 41, respectively, that are secured to said radial support members. Hub 37 is attached to shaft 16. The propulsion assembly is positioned in intervening region 34 in sliding abutment with the facing extremities of the forward and rear portions of chamber 13. The power blades are positioned within annular interstitial zone 26 and are pitched in a manner such that rotation of shaft 16 drives water rearwardly. Support members 38 may be in the form of vanes uniformly pitched so as to produce rotation as a result of fluid force applied thereto in a direction parallel to axis 17.

A plurality of steam injector nozzles 42 are disposed within the forward portion of chamber 13 around said shaft, and are directed toward exit port 32. Conduit pipes 45 convey high pressure steam through forward portion 27 to said nozzles. High velocity steam emergent from said nozzles provides three functions, namely: a) it prevents water from entering chamber 13 through intervening region 34; b) it augments the rotational movement of said propulsion blade assemblies when support members 38 have a vane configuration; and c) it provides further impetus to the velocity of the rearwardly moving stream of water passing through interstitial zone 26 and exiting through exhaust portal 18. In achieving propulsion-augmenting effect c), the steam emergent from said nozzles undergoes a phase change to liquid water upon the interior surface 43 of rear portion 31 of chamber 13. Such phase change produces even greater propulsion efficiency within the waterjet drive of the present invention because it causes the condensed water to merge with and push against the water from the interstitial zone, instead of merely blowing steam bubbles into the water stream.

In an alternative embodiment of the engine of the present invention, shaft 16 may instead be comprised of coaxial interior and exterior shafts which rotate in opposite directions, thereby causing opposite rotational direction of said propulsion blade assemblies. In such embodiment, which may involve a standard transmission inverter associated with turbine 12, the direction of pitch of blades 39 and support members 38 will be opposite for each propulsion blade assembly 36.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A turbine-driven waterjet drive engine comprising:

a) a water conduit elongated upon a center axis and having a rearwardly directed exhaust portal centered upon said axis, a middle portion of larger diameter than the diameter of said exhaust portal and symmetrically configured with respect to said axis, and a forward extremity having a water intake portal, b) a hollow axially symmetrical chamber centrally positioned within said middle portion and defining therewith an annular interstitial zone, said chamber having a streamlined forward portion and convergently tapered rear portion having an axially centered exit port, c) an axially centered shaft which enters said water conduit at said forward extremity, extends through said forward chamber portion, and terminates in a distal extremity, said shaft being journaled with respect to said water conduit and forward chamber portion for rotation about said axis, d) a centrifugally balanced propulsion assembly associated with the distal extremity of said shaft and comprised of: 1) a hub, 2) a plurality of support members emergent from said hub in a radial direction with respect to said shaft and terminating in outermost extremities, and 3) a circular array of propulsion blades associated with said outermost extremities within said interstitial zone and pitched so as to drive water rearwardly with rotation of said shaft, and e) a plurality of steam injector nozzles disposed within said forward chamber portion and directed toward said exit port.

2. The engine of claim 1 wherein said chamber is supported by a series of struts which extend in joinder between said chamber and said water conduit.

3. The engine of claim 2 wherein said forward and rear portions are separate halves of said chamber and brought together in spaced apart facing juxtaposition defining an intervening region.

4. The engine of claim 3 wherein said propulsion assembly is disposed within said intervening region.

5. The engine of claim 4 wherein said support members are in the form of vanes uniformly pitched so as to produce rotative force in the direction of shaft rotation as a result of fluid force applied to said vanes in a direction parallel to said axis and toward said exit port.

6. The engine of claim 4 wherein said propulsion assembly is positioned in sliding abutment with said forward and rear portions within said intervening region.

7. The engine of claim 1 wherein steam emergent from said injector nozzles is caused to condense to water within said rear portion.

* * * * *